US006390884B1

(12) United States Patent
Dragojevic

(10) Patent No.: US 6,390,884 B1
(45) Date of Patent: May 21, 2002

(54) APPARATUS AND METHOD FOR ENHANCING A WOMAN'S CLEAVAGE

(76) Inventor: Seka Dragojevic, 3230 NE. 13th St., #208, Boca Raton, FL (US) 33062

( * ) Notice: Subject to any disclaimer, the term of this patent is extended or adjusted under 35 U.S.C. 154(b) by 0 days.

(21) Appl. No.: 09/789,786

(22) Filed: Feb. 20, 2001

(51) Int. Cl.[7] ..... A41C 3/00
(52) U.S. Cl. ..... 450/1; 450/71
(58) Field of Search ..... 450/1, 105, 59, 450/60, 71–73, 77, 106, 67, 69, 78.1, 8–10, 114, 17, 12, 79.1; 63/14.4, 14.1, 14.8, 9.11, 22; 2/67, 69, 78.1, 104–106, 113–115; 243/3.11, 3.12, 49.1, 59, 60, 61, 62, 65, 66.4, 66.5, 66.6, 66.8, 66.11, 66.13, 66 J

(56) References Cited

U.S. PATENT DOCUMENTS 1,345,216 A * 6/1920 Norbett ..... 24/66.8
1,655,224 A * 1/1928 Hirsch ..... 450/59
1,993,734 A * 3/1935 Edelheit ..... 24/66.8
2,641,763 A * 6/1953 Schroeder ..... 450/59
2,908,276 A * 10/1959 May ..... 450/59
3,196,878 A * 7/1965 Hedu ..... 450/59
4,325,378 A * 4/1982 Wilkinson ..... 450/59
4,412,357 A * 11/1983 Mincher ..... 450/59
4,955,846 A * 9/1990 Greenberg ..... 450/59
5,609,042 A 3/1997 Williams
5,868,601 A * 2/1999 Kelemencky ..... 450/59
6,247,207 B1 * 6/2001 Nitsche ..... 24/66.4

* cited by examiner

*Primary Examiner*—Gloria M. Hale
(74) *Attorney, Agent, or Firm*—John C. Smith

(57) ABSTRACT

A breast cleavage enhancement device which is selectably attached to the rim of a brassiere at multiple locations. Depending on the point of attachment to the brassiere, the brassiere cups are rotated in a clockwise or counter clockwise direction to control the position, cleavage, and separation of the breasts. The adjustable clip is attached to the brassiere at various user selectable locations between the brassiere cups. Placement of the adjustable clip above or below the center point applies rotational pressure to the brassiere cups, which will move the breasts closer together if rotated in one direction, and will move the breasts apart if rotated in the other direction. The adjustable clip can be implemented by a clip that attaches to a conventional brassiere, or by integral hook and loop strips, buttons, string ties, or other suitable devices. Alternative embodiments implement the breast rotation feature on the upper portion of a two-piece bathing suit, and use ornamental clasps to secure the brassiere cups together.

27 Claims, 10 Drawing Sheets

APPARATUS AND METHOD FOR ENHANCING A WOMAN'S CLEAVAGE

BACKGROUND OF THE INVENTION

1. Technical Field

The present invention relates to the breast support devices. In particular, it relates to a device that allows a user to dynamically adjust the manner in which an undergarment, such as a brassiere, supports and controls the position of the breasts to enhance the breasts' cleavage and to enhance the perceived fullness and firmness of the breasts.

2. Background Art

The use of devices, such as brassieres, to support a woman's breasts is well-known in the art. Traditionally, these devices have merely provided support for the breasts. More recently, attempts have been made to enhance the cleavage and appearance of a woman's breasts by pulling the individual breast supports together, thereby enhancing the perceived size of the breasts as well as the cleavage.

While these devices serve their purpose to an extent, they also have some disadvantages. In particular, prior art devices are restricted in that they only pull the breasts together to increase cleavage, and only push the breasts up to increase perceived size. In addition, they do not allow the wearer to dynamically adjust the amount of cleavage, or the position of the breasts, to suit a particular outfit or social event. It would be advantageous to have a brassiere that would allow the wearer to dynamically change the manner in which the brassiere controls the position and cleavage of the woman's breasts.

Another disadvantage associated with brassieres is that when breasts are pulled together laterally for the purpose of enhancing cleavage and pulled up for the purpose of enhancing the perceived size of the breasts, the brassiere also occasionally produces some undesirable side effects. In particular, when the brassiere pulls the breasts together, it sometimes creates the appearance of creases or wrinkles in the breasts which makes the breasts unattractive and increases the apparent age of the woman. It would be desirable to have a method of adjusting and controlling a brassiere such that the cleavage of a woman could be improved while still maintaining a smooth surface texture on the skin of the breasts.

Another problem associated with brassieres is that they do not take into account the fact that humans are not perfectly symmetrical. For example, the size of an individual's hand may vary, the size of an individual's feet may vary, etc. That is why one shoe may often fit better than the other shoe worn by an individual. In the case of women, it is fairly common that one breast may be larger than another, or may be positioned lower or higher on the chest than the other, etc. Prior art brassieres do not account for this difference between symmetrical parts of an individual body. It would be desirable to have a brassiere which would allow a woman to dynamically control not only the cleavage of the breasts as a pair, but also to dynamically control the cleavage and position of each breast individually.

While addressing the basic desirability of using brassieres, the prior art has failed to provide a device which is inexpensive to manufacture and use, which can be integrated with a brassiere at the point of manufactured or used in conjunction with a conventional brassiere as a retrofit attachment, and which allows an individual woman to dynamically control the amount of cleavage provided by a brassiere, to dynamically control the perceived size of the breasts, and to control the position and cleavage of each breast independent of the other breast without the drawbacks of the prior art, such as perceived wrinkles created by the pressure of brassieres which laterally press breasts together and upward to increase perceived cleavage.

SUMMARY OF THE INVENTION

The present invention solves the foregoing problems by providing an adjustable brassiere which rotates the cups supporting the breasts in a clockwise or counter clockwise direction under control of the wearer. The pressure is applied between the brassiere cups above or below the midpoint of the brassiere cups such that rotational pressure is applied. The point at which the pressure is applied determines the amount of rotation and the rotational direction of the brassiere cups. The pressure mechanism can be fabricated as pair of the brassiere or, alternatively, it can be implemented as an add-on feature to retrofit conventional brassieres. Depending on the point of attachment of the pressure mechanism to the brassiere, each cup of the brassiere is rotated in a clockwise or counter clockwise direction. By attaching the pressure mechanism at various locations between the brassiere cups, the brassiere cups which hold the breasts are pulled together at a greater or lesser degree. Placement of the adjustable clip above or below the center point applies rotational pressure to the brassiere cups, the direction and strength of the rotational pressure controlled by the location of the pressure mechanism. Rotation in one direction will appear to move the breasts closer together and rotation in the other direction will appear to move the breasts apart. One embodiment of the pressure mechanism is implemented by an adjustable clip that attaches to a conventional brassiere. Additional embodiments use integral attachment devices which may be clips, hook and loop strips, buttons, string ties, or other suitable devices. In a preferred embodiment, the pressure mechanism is attached to different locations on each brassiere cup such that each brassiere cop is rotated a greater or lesser amount than the other brassiere cup which allows the cleavage and perceived size of each breast to be individually adjusted to compensate for slightly asymmetrical breasts.

DESCRIPTION OF THE PREFERRED EMBODIMENT

Figure 1:
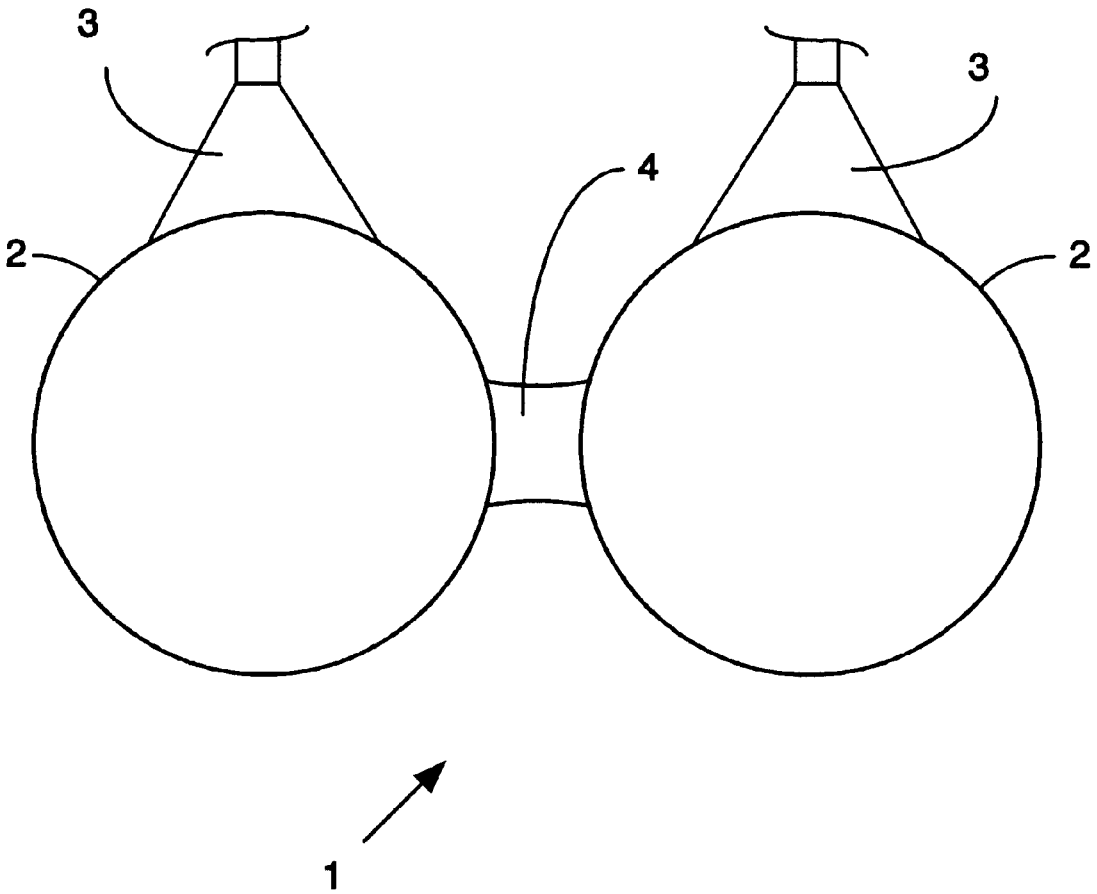
Figure 1 Prior Art
FIG. 1 is a front view of a prior art brassiere which illustrates a brassiere which does not modify cleavage.

Prior to a detailed discussion of the figures, a general overview of the features and advantages of the invention will be presented. As noted above, attempts have been made to enhance the cleavage and appearance of a woman's breasts through the use of devices associated with brassieres. Most notably, the attempts have been confined to pulling the cups of the brassiere together or increasing the support provided by a brassiere to lift the breasts. While this has been successful to a point, it has the drawbacks discussed above in regard to not allowing an individual wearing to control the amount of adjustment. Further, it induces an additional problem in that when the brassiere cups are pulled together laterally to increase cleavage, a side effect occurs in which the skin on the top surface of the breast becomes wrinkled creating the illusion that the individual is older than the individual actually is.

The invention improves upon the prior art by providing an adjustable device which allows the user to not only to pull the brassiere cups together laterally, but it also allows the user to simultaneously apply rotational pressure to the brassiere cups to alter the manner in which the breasts are supported and cleavage is perceived. By attaching the adjustable device to the lower portion of the brassiere, the brassiere cups are rotated such that the upper portion holds the breasts apart and smooths the surface of the breast's skin. Likewise, by applying the adjustable device above the center point of the brassiere, the brassiere cups are rotated such that breasts are pulled together. This rotational pressure positions the breasts such that the wrinkles created by lateral moment of the breasts is eliminated. As a result, it avoids the false impression of aging created by prior ail brassieres used to enhance cleavage by eliminating the wrinkles created by those brassieres that only move the breasts laterally. The smoother skin on top of the breasts provides an enhanced appearance of youth.

Another advantage of this invention is that it provides the ability to dynamically adjust where pressure is applied, to dynamically select how much pressure is applied, and to dynamically determine the rotational direction of the brassiere cups. By providing this dynamic control, the adjustable brassiere provided herein allows the wearer to use the same brassiere to create a different impression for different occasions depending on the type of outfit being worn, and the appearance that the wearer is attempting to make. Prior to this, an individual would have to have several brassieres to meet the different ends of the wearer. For example, the user may have a push up brassiere for one type of dress, and a different type of brassiere for casual clothing.

Since the adjustable device is preferably attached above the midpoint of the brassiere or below the midpoint of the brassiere, the rotational pressure will be applied in opposite directions for each brassiere cup. For example, if the adjustable device is attached to the brassiere cups above the midpoint of the brassiere, the adjustable device will rotate the left brassiere cup in a counter clockwise direction and the right brassiere cup in a clockwise direction. This will have the effect of pulling the breasts together. On the other hand, if the adjustable device is attached to the brassiere cups below the midpoint of the brassiere, then the adjustable device will rotate the left brassiere cup and clockwise direction and the right brassiere cup in a counter clockwise direction. This will have the effect of pulling the breasts away from one another. As can be seen, this process allows a woman to selectably adjust the rotational pressure to produce the exact amount of cleavage desired for a particular outfit or appearance.

The invention can be implemented in the form of a retrofit device, such as a clip, which is attached to a conventional brassiere. The use of a detachable clip in combination with a conventional brassiere allows the wearer to create an adjustable brassiere from a pre-existing conventional brassiere in the wearer's wardrobe and to simultaneously adjust how it supports the wearer's breasts. This allows the woman to adjust the brassiere to suit a particular outfit. As a result, the woman will save money by not having to have as extensive a collection of brassieres as would heretofore be necessary. In addition, it allows the wearer to take fewer garments with her when she travels.

Another advantage provided by this invention over the prior art is that the invention takes into account symmetrical differences in a woman's body. Just as other symmetrical parts of an individual's body (i.e. hands, ears, feet, legs, arms, etc.) vary in size and shape, a woman's breasts also vary in size, fullness, shape, and position on the chest. The pressure device allows the woman to compensate for such differences by applying different types of rotational force to each breast. In particular, when the pressure device is attached to the two opposing brassiere cups, if it is attached that the same lateral position then the rotational force should be approximately equal. However, if the pressure device is attached to a certain position on one brassiere cup, and the other end of the pressure device is attached to the opposing brassiere cup at a slightly higher or lower position, then the two brassiere cups will have different amounts of rotational pressure applied. This allows a woman to provide more rotational pressure on one breast or the other which in turn changes the appearance of one breast in relation to the other.

Those skilled art will recognize that as the rotational control of the brassiere is implemented to suit goals and objectives of this invention, it can be implemented in one of many ways. For example, it is possible to use a detachable clip that can be used with conventional brassieres. This allows to use a single clip in conjunction with numerous brassieres. It is also possible to retrofit brassieres with other rotational pressure devices. For example, a simple hook and loop strip sewn or attached along the side edge of each brassiere cup allows a corresponding hook and loop strip to attach to various locations on the hook and loop strip's on the brassiere cup. This provides the ability to alter the rotation and the amount of rotational pressure by moving the open loop strip that connects the two brassiere cups. An advantage of a detachable clip is that it allows the benefits of the invention to be gained without replacing the entire brassiere. Likewise, a clip can be replaced with integral devices that are manufactured as a part of the brassiere. The integral devices can be clips, hook and loop devices, buttons, string ties, etc. The materials used to fabricate the adjustable device can be any suitable material, such as metal or plastic clips, etc. We turn now to a more detailed discussion of the figures.

Referring to FIG. 1, this figure shows a prior art brassiere 1. In this figure, the brassiere 1 has two cups 2 which support the wearer's breasts. The cups 2 are supported by shoulder straps 3. Also shown in this figure is connecting strap 4. In this type of conventional brassiere 1, the brassiere 1merely supports the breasts and does not manipulate their position.

Figure 2:
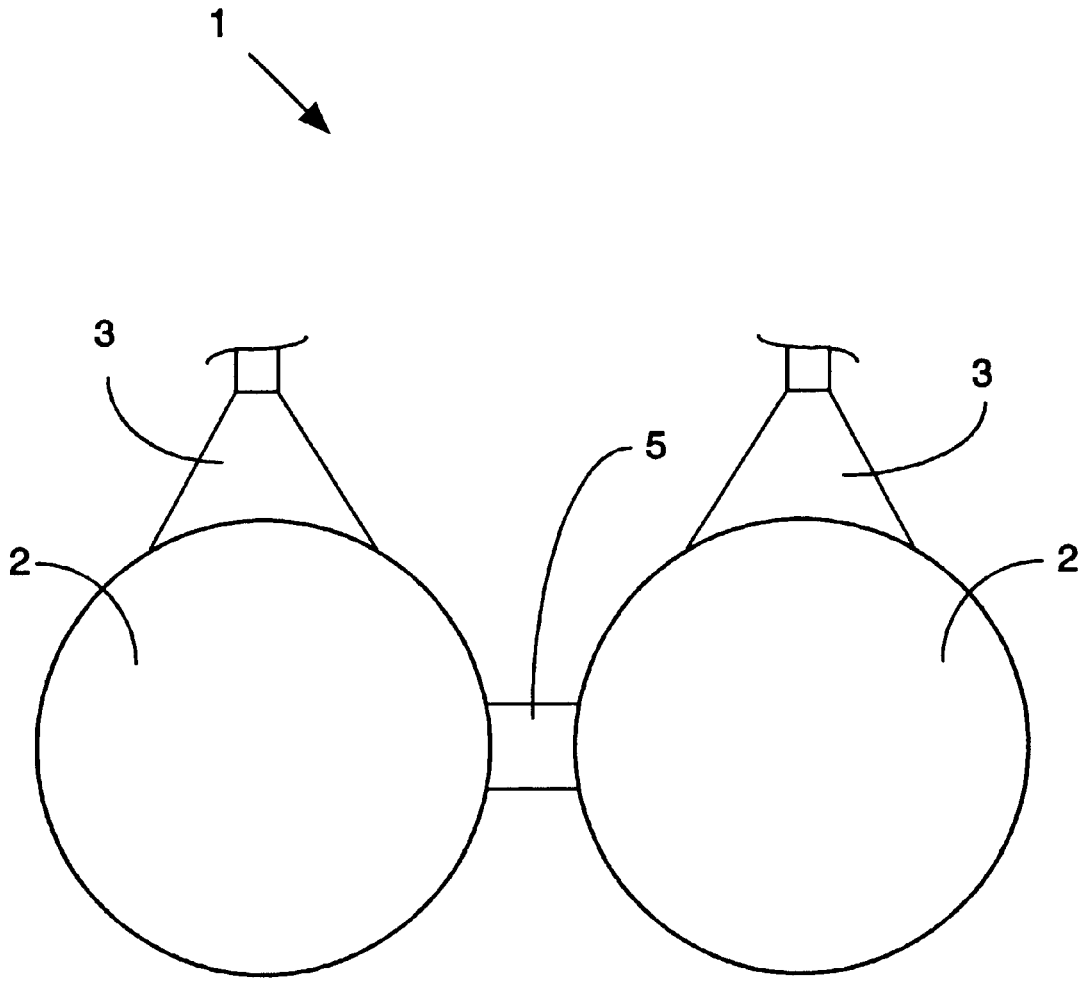
Figure 2 Prior Art
FIG. 2 illustrates a front view of a prior art brassiere which has a tension strap the pulls the breasts together to enhance cleavage.

FIG. 2 illustrates another type of prior art brassiere 1 that attempts to enhance cleavage. In this embodiment, brassiere cups 2 are connected by a tension strap 5 which pulls the cups 2 of the brassiere 1 together. As the cups 2 are pulled together, the breasts are pressed against one another to enhance cleavage. Likewise, the straps 3 can be used to provide upward pressure to the brassiere cups 2. Unfortunately, this type of prior art brassiere 1 merely pulls the cups 2 together laterally. A disadvantage of this method is that it often distorts the appearance of the breast, and in addition, it may cause wrinkling of the skin on top of the breasts while it is won. As a result, the benefits of improved cleavage may be offset by the appearance of wrinkles and the illusion of advanced age.

Figure 3:
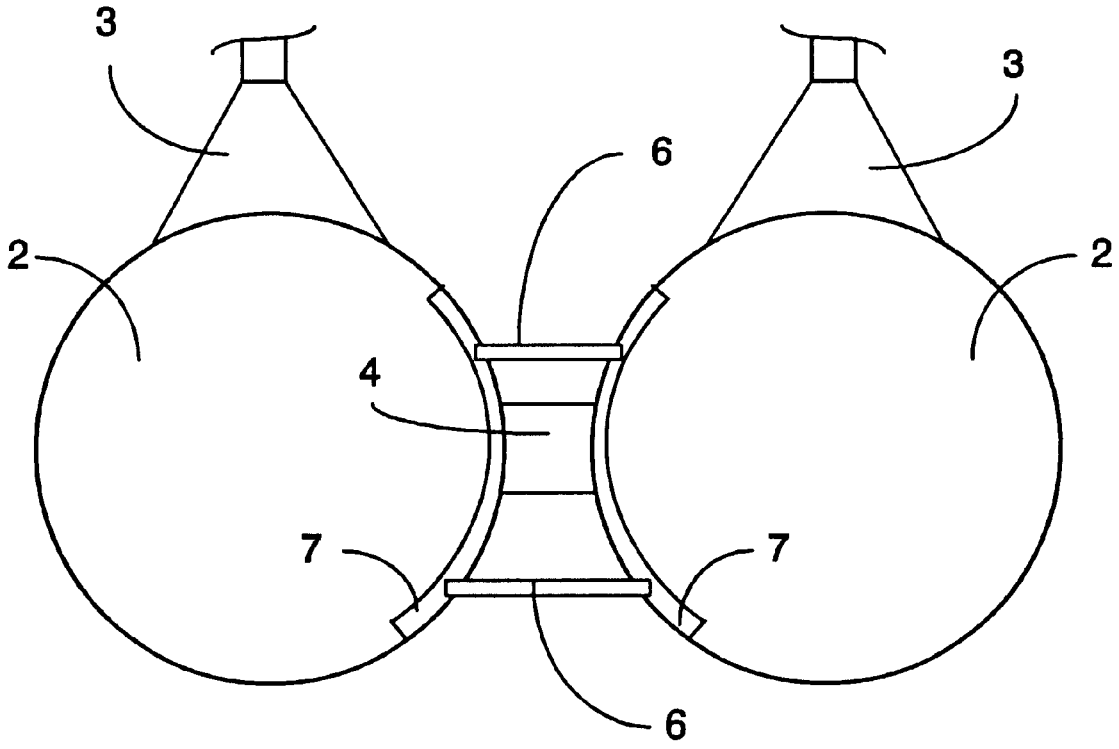
FIG. 3 illustrates a front view of a preferred embodiment of the brassiere in which hook and loop strips are positioned on the side of the brassiere cups facing one another with hook and loop ties straps applying rotational pressure to the two cups.

Referring to FIG. 3, this figure illustrates a preferred embodiment of the invention in which ties straps 6 are attached to securing strips 7 on the sides of the brassiere cups 2. This embodiment shows many of the elements of a conventional brassiere 1, including the cups 2, the shoulder straps 3 and the connecting strap 4. In addition to these elements, tie straps 6 are also shown. For ease of illustration, two tie straps 6 are shown to illustrate how a tie strap 6 can be positioned at upper and lower locations in regard to the brassiere cups 2. Of course, in practice only one tie strap 6 would be used since each tie strap 6, if positioned at upper and lower locations on the brassiere cups 2, would offset the rotational force of the other.

By locating the tie strap 6 at various positions along the securing strips 7 the amount of rotational force can be adjusted to provide greater or lesser rotation. In addition, depending on whether the tie strap 6 is positioned above or below the middle of the brassiere cup 2, the direction of rotation will be reversed. Likewise depending on whether the tie strap 6 is attached at its ends to the securing strips 7, or attached at some point nearer the middle of the tie strap 6, the amount of rotational pressure can be varied.

For ease of illustration, the pressure device has been illustrated in this figure as securing strips 7 and hook and loop tie straps 6. However, equivalents devices can be substituted for the hook and loop material discussed above. For example, buttons can be sewn on the side of the brassiere cups 2, and simple tie strings can be used in place of the tie straps 6. In this case, the tie strings are tied to buttons on opposing brassiere cups 2. The woman can control the pressure by selecting a particular set of buttons and by adjusting the length of the tie string as it is attached. Likewise, metal hooks attached to the ends of a connecting strap can be attached to the support rims of the brassiere cups 2. This can be accomplished by a single double headed hook, by two metal hooks attached to one another, or by two metal hooks attached to opposite ends of a connecting strap. The only requirement is that the pressure device must be able to securely attach to the brassiere cups 2 and should be able to apply tension at the point where they are attached to the brassiere cups 2.

Figure 4:
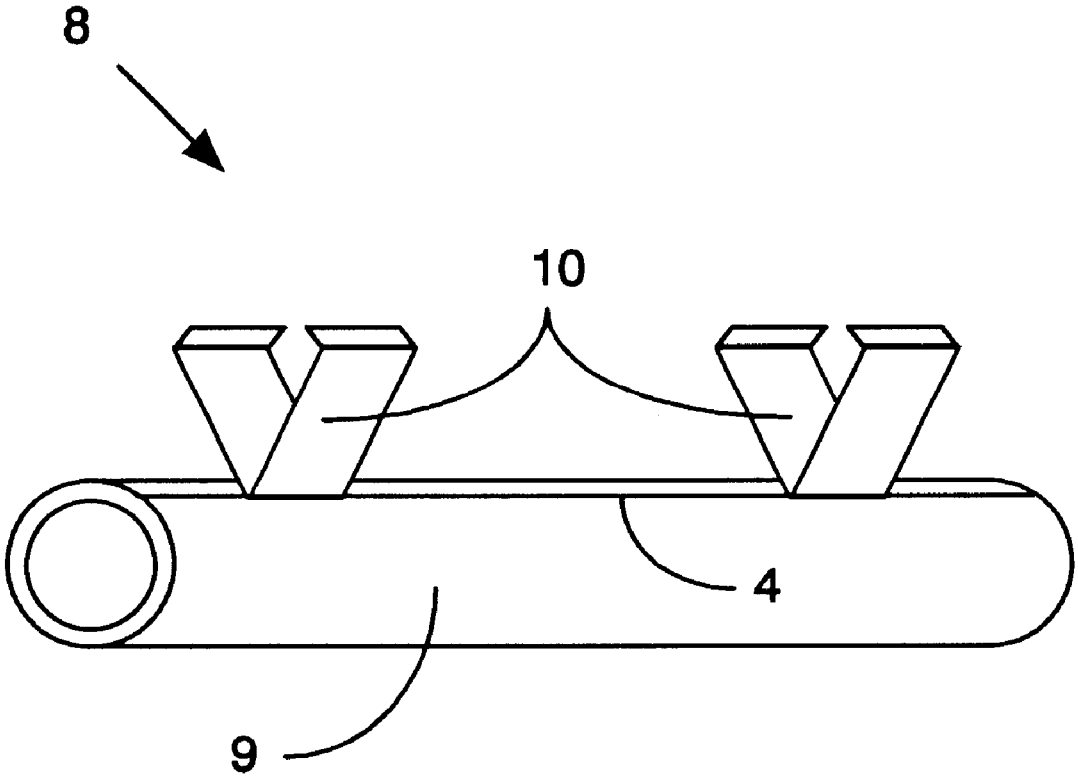
FIG. 4 is a preferred embodiment of the invention which illustrates a brassiere pressure device in the open position.

Referring to FIG. 4, this figure illustrates a preferred embodiment of a pressure device 8 which can be substituted for the hook and loop pressure device illustrated in the foregoing figure. In this embodiment, two spring loaded clip jaws tend are slidably mounted within a slide track 11 in the clip support 9. For ease of illustration, the clip jaws 10 are shown in the open position. In the open position, the arms of the clip jaws 10 are spread apart to allow the clip jaws 10 to be attached to the edge of the brassiere's cups 2 (shown in FIGS. 1–3). In practice, the arms of the clip jaws 10 would normally be held under spring tension in the closed position where they would grip the edge of the brassiere cup 2. The arms of the clip jaws 10 are held together in the closed position by a spring (not shown) in the clip jaws 10 which is located inside the clip support 9. Spring loaded clips are well-known in the art.

To rotate the brassiere cups 2, one clip jaw 10 is attached to each brassiere cup 2. Depending on the position of the brassiere cup 2 at which it is attached, the pressure device 8 will provide greater or lesser rotational pressure to the brassiere cup 2. Likewise, by sliding the clip jaws 3 along slide track 4, the rotational pressure on the brassiere cup 2 can also be adjusted. Of course, while the clip jaws 10 can slide along slide track 11, the clip jaws 10 must be snug enough inside the slide track 11 of clip support 9 to avoid any unintended slippage resulting from the rotational pressure it is applying to the brassiere cup 2.

Those skilled in the art will recognize that numerous modifications can be made to the structure of the invention, and that the foregoing embodiment should be considered as exemplary only. In addition, any suitable material can be used to fabricate the pressure adjustment device 8, such as plastic, metal, wood, etc.

Figure 5:
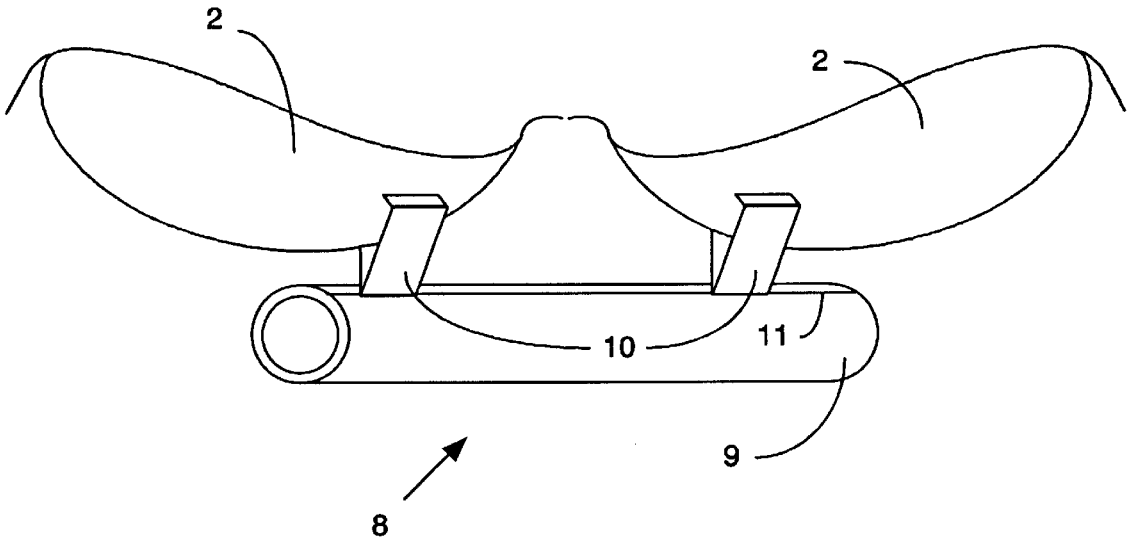
FIG. 5 illustrates a preferred embodiment of the brassiere pressure device attached to the lower the edge of the cups of a brassiere.

In FIG. 5, the brassiere adjustment device 8 is shown attached to the cups 2 of the brassiere. The clip jaws 10 can be slidably attached, has discussed above, or alternatively, they can be fixed in position. If the clip jaws are permanently attached to the clip support 9, then the amount of rotational pressure will be selected based on where the clip jaws 10 are attached to the brassiere cups 2. Likewise, those skilled in the art will recognize that even if the clip jaws 10 are slidably attached to the clip support 9, the amount of rotational pressure can also be adjusted based on the selection of where the clip jaws 10 are attached to the brassiere cups 2.

The foregoing discussion described the attachment of the pressure device 8 to the lower portion of brassiere cups 2. Attachment of the pressure device 8 to the lower portion of the brassiere cups 2 rotates the brassiere cups 2 in one direction. In particular, the rotational pressure will move the upper portion of the breasts apart. By attaching the pressure device 8 to the upper portion of brassiere cups 2, rotational pressure will be in the opposite direction, resulting in the upper portion of the breasts being pulled together. Depending on where the pressure device 8 is located, the device can selectably adjust the amount of rotational pressure which will in turn control the amount of cleavage and the appearance of the breasts.

The invention uses pressure that is applied to specific points on the brassiere cup 2 which results in the brassiere cup 2 being rotated in one direction or another. As can be seen from the foregoing embodiments, a variety of devices, such as hook and loop strips, string ties, mechanical clips, etc. can be used to achieve the goals of the invention. The important step is in having dynamic and adjustable control over the brassiere cup 2 so that it can be conveniently rotated in one or both directions to suit the individual needs of the wearer.

Figure 6:
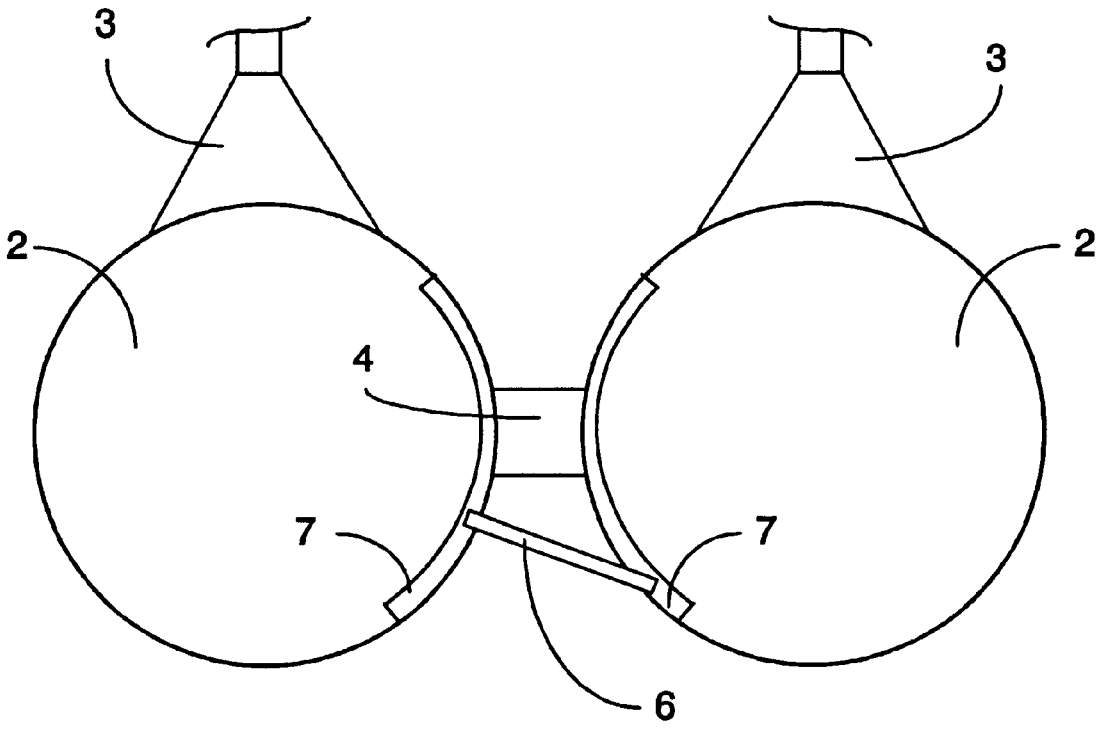
FIG. 6 illustrates a preferred embodiment of the invention in which the pressure device is attached asymmetrical he the purpose of applying more pressure to one brassiere cup than the other.

FIG. 6 illustrates how rotational pressure can be applied asymmetrically to each brassiere cup 2. The purpose of applying pressure in this asymmetrical fashion is to compensate for differences in this imagery of the individual person wearing the brassiere 1. To accomplish this, one end of the pressure device would be attached to a brassiere cup 2 closer to the midpoint of the brassiere 1 than the other end of the pressure device would be attached to the other brassiere cup 2. As shown in this figure, tie strap 6 is asymmetrically attached to hook and loop strips 7 such that one end of tie strap 6 is attached to a brassiere cup 2 near the midpoint of the brassiere cup 2. The other end of tie strap 6 is attached to the opposing brassiere cup 2 at the lower point. The farther away from the midpoint of the brassiere cup 2, the more rotational pressure is applied. Likewise, the closer to the midpoint of the brassiere cup 2 that the pressure device is attached, the more lateral rather than rotational pressure is applied.

Figure 7:
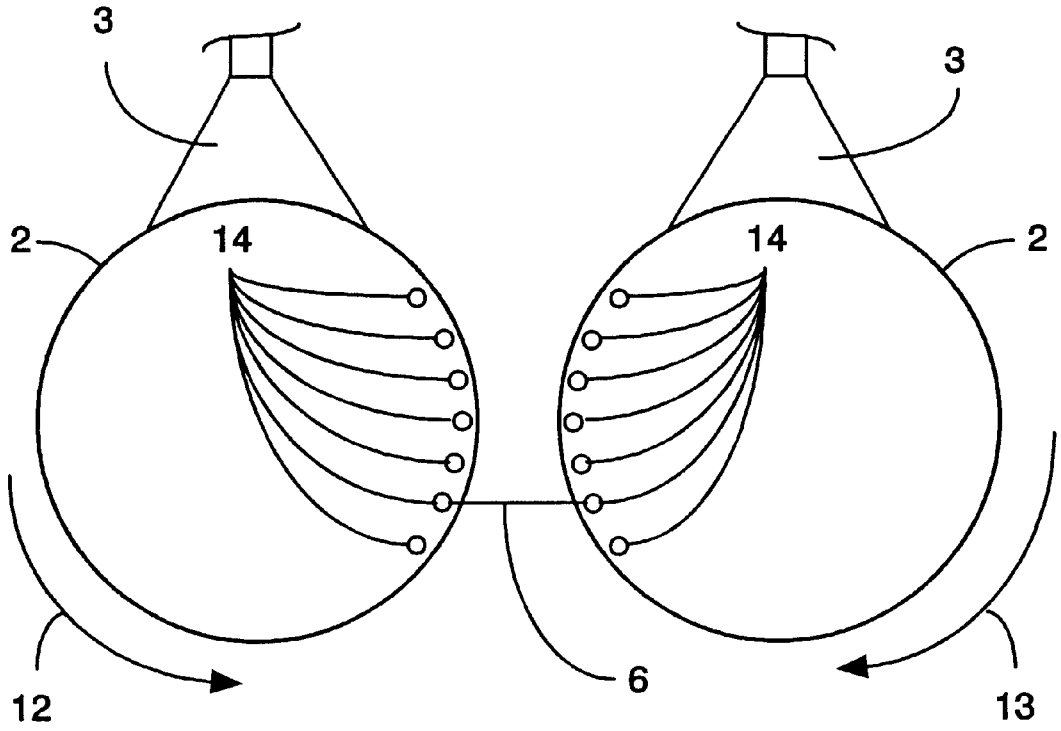
FIG. 7 illustrates an alternative preferred embodiment in which the connecting strap is illuminated and the tie straps perform the function of holding the brassiere cups in place.

FIG. 7 is another alternative preferred embodiment. This embodiment is similar to the embodiment of FIG. 3 with the following exceptions: first, the connecting strap 4 which is found in most conventional brassieres 1 has been eliminated. In this embodiment, the tie strap 6 is used to hold the brassiere cups 2 in place. Also, this embodiment illustrates that the hook and loop material shown in FIG. 3 can be replaced with alternative securing mechanisms such as simple string which functions as the tie strap 6. The tie strap's 6 are secured to apertures 14 which are arranged around the periphery of the brassiere cup 2 in the area where the brassiere cups 2 are adjacent to one another. In this figure, one end of the tie strap 6 is inserted through an aperture 14 on a first brassiere cup 2 and secured to it via tying, while the other end of the tie strap 6 is inserted through an aperture 14 on the second brassiere cup 2 and, likewise, secured to it via tying.

By selecting the appropriate aperture 14, the user can control the amount of rotation of the brassiere cups 2. Likewise, the user can also control the rotation depending on how tightly the brassiere cups 2 are pulled together when the user secures the tie strap 6 to the apertures 14. The direction of rotation is illustrated by rotation lines 12, 13. As shown in this figure, by a securing the tie strap 6 to the brassiere cups 2 in a location which is on the lower part of the brassiere cups 2, the lower portion of the brassiere cups 2 will rotate toward one another which in turn rotates the upper part of the brassiere cups 2 away from one another. Of course, by placing the tie strap 6 above the midpoint of the brassiere cups 2, the cup rotation will be in the opposite direction.

Those skilled in the art will realize that alternative securing methods may be used in place of the apertures 14. For example, small hooks can be secured to each brassiere cup 2 and a tie strap 6 with loop ends or matching hooks suitable for attaching to the hooks on the brassiere cups 2. These hooks can easily be fabricated using the same type of hooks which are commonly used to secure the back strap of a brassiere together.

Figure 8:
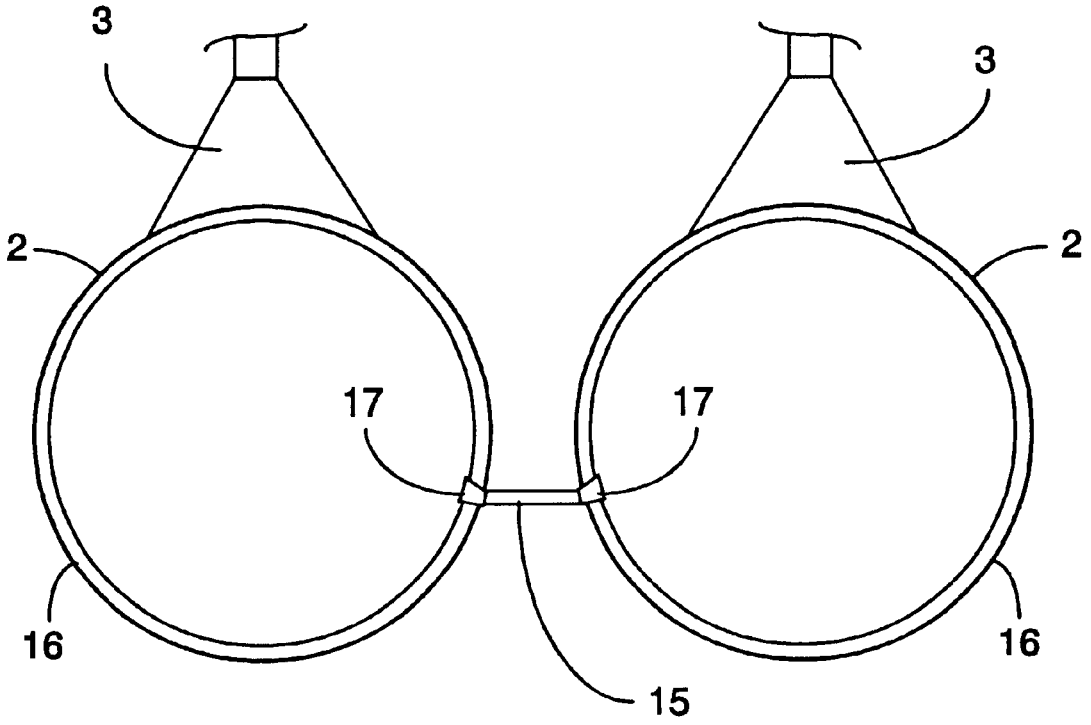
FIG. 8 is an alternative preferred embodiment in which the tie strap has clips which attach to the edge of the brassiere cup.

In FIG. 8, another alternative embodiment is shown. In this embodiment, a tie strap 15 is used which incorporates clips 17 that attach to the rim 16 of the brassiere cup 2. Preferably, the clips 17 would attach to the rim 16 via pressure fit. Because many conventional brassieres 1 have wires located around the perimeter of the brassiere cup 2, the tie strap 15 which incorporates clips 17 may be used in conjunction with a conventional brassiere 1 to convert a conventional brassiere 1 to a brassiere 1 having the benefits and advantages of the invention. In addition, says this strap does not rely on apertures or other securing mechanisms which are located at fixed positions, the user has an unlimited number of adjustable positions.

Figure 9:
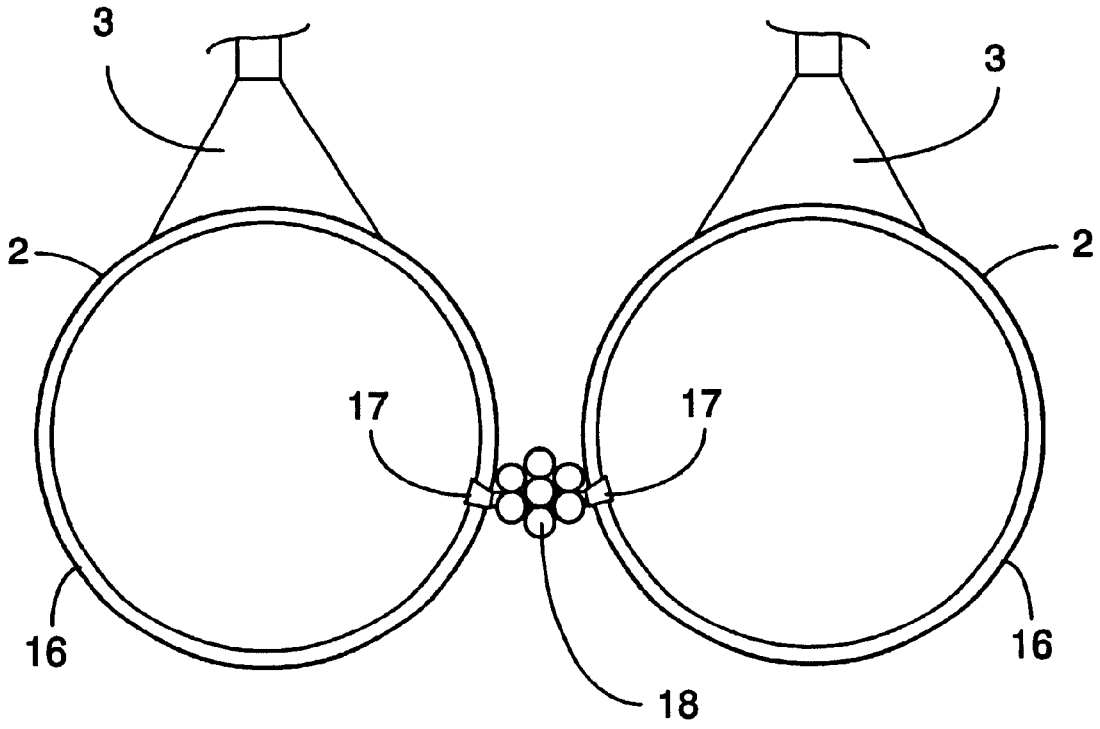
FIG. 9 is an alternative preferred embodiment in which the tie strap incorporates decorative features such as jewelry.

FIG. 9 illustrates an alternative embodiment which incorporates a decorative tie strap 18. The decorative tie strap 18 can be used to enhance the appearance of the brassiere 1 by providing an attractive ornamental aspect to the tie strap 18 which can conceal the functional operation of the tie strap 18 from a viewer. In this figure, the decorative tie strap 18 uses a cluster of pearls to conceal a tie strap 18. Of course, any type of decorative structure can be used in place of the pearl encrusted tie strap 18 shown in this figure. For example, precious metals, gem stones, ceramics, or any other type of sculpted artwork which would enhance the appearance of the wearer. The type of material, or its configuration, would only be limited by the imagination of the artist creating the tie strap 18. Likewise, the decorative tie strap 18 does not have to be a strap in the conventional meaning of that term. In particular, the decorative tie strap 18 can be fabricated as a rigid clasp rather than a flexible strap.

Figure 10:
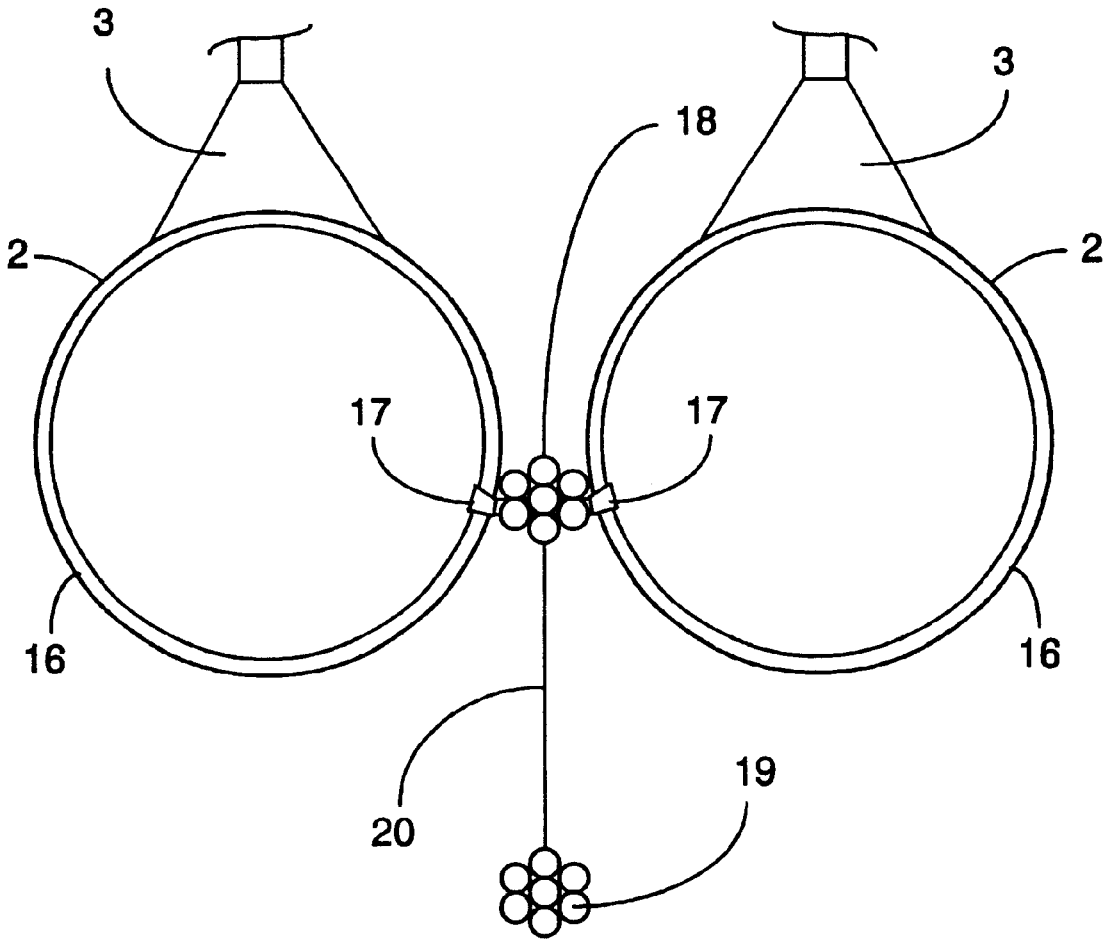
FIG. 10 illustrates another alternative embodiment in which the top portion of a two-piece bathing suit implements the invention and tie strap incorporates a jewelry display feature.

FIG. 10 illustrates another alternative embodiment of the invention. In this embodiment, the decorative tie strap 18 is used as an anchor to hold additional jewelry 19. In this figure, the jewelry 19 is shown suspended from the decorative tie strap 18 via a string 20. Those skilled in the art will recognize that the jewelry 19 can be any form of jewelry suitable for its purpose, and the string 20 can be fabricated from any suitable material, such as gold or other precious metals, etc.

This embodiment also illustrates another advantage of this invention. In particular, the embodiments discussed herein have heretofore discussed the features and advantages of the invention in terms of its application to a brassiere undergarment. However, the features and advantages of the invention can also be implemented in regard to the upper portion of a two-piece bathing suit. As a result, for purposes of discussion herein, the term "brassiere" is intended to mean not only what is conventionally referred to as a brassiere, but also to include the upper portion of a bathing suit which is structurally similar to a conventional brassiere. In fact, since the upper portion of a two-piece bathing suit will typically not be covered by additional clothing items, such as a brassiere would, the benefits of the invention would be even more advantageous when used in combination with a two piece bathing suit.

While the additional jewelry 19 may not normally be visible when used in conjunction with a brassiere 1, those skilled in the art will recognize that the advantages of the additional jewelry 19 are particularly valuable when used with a two piece bathing suit. When used in combination with a bathing suit, the jewelry 19 is easily visible and enhances the appearance of the wearer.

While the invention has been described with respect to a preferred embodiment thereof, it will be understood by those skilled in the art that various changes in detail may be made therein without departing from the spirit, scope, and teaching of the invention. For example, the material used to construct the brassiere adjustment device may be anything suitable for its intended purpose, the size and shape of the brassiere adjustment device can vary. The method of attaching the brassiere adjustment device to the brassiere can vary. Likewise, the brassiere adjustment device can be removably or permanently attached to a brassiere. Accordingly, the invention herein disclosed is to be limited only as specified in the following claims.

I claim:

1. A brassiere cup adjustment device for attachment to a brassiere having adjacent brassiere cups and for applying rotational pressure to the adjacent brassiere cups, comprising:

cup rotation means for applying opposing rotational forces to adjacent brassiere cups in a brassiere, further comprising:

first attachment means attached to a first end of the cup rotation means for attachment of the first end of the cup rotation means to a first brassiere cup;

second attachment means attached to a second end of the cup rotation means for attachment of the second end of the cup rotation means to a second brassiere cup; and the cup rotation means further applying tension to the first and second brassiere cups where the cup rotation means are attached to the brassiere cups;

the tension generated by the cup rotation means, when attached to an upper portion of the brassiere cups, providing rotational pressure to rotate the upper portion of the brassiere cups toward one another, and when the cup rotation means are attached to a lower portion of the brassiere cups, providing rotational pressure to rotate the upper portion of the brassiere cups away from one another;

whereby the rotational pressure applied to brassiere cups causes the brassiere cups to rotate and to alter the amount of perceived cleavage when the brassiere is worn.

2. A device, as in claim 1, wherein the cup rotation means is detachably attachable to the brassiere.

3. A device, as in claim 2, wherein:

the first an second cup attachment means are clips.

4. A device, as the claim 3, comprising:

the clips further comprise jaws which extend from the clip to grasp the brassiere.

5. A device, as in claim 2, wherein:

the first and second cup attachment means are first and second hook assemblies, the first hook assembly having means to attach to the first brassiere cup, and the second hook assembly having means to attach to the second brassiere cup.

6. A device, as in claim 2, wherein:

the cup rotation means further comprises a connecting strap comprised of hook and loop material the connecting strap attached at a first end to a first brassiere cup and attached at a second end to a second brassiere cup.

7. A device, as in claim 2, wherein the cup rotation means is an ornamental clasp.

8. A device, as in claim 7, further comprising:

jewelry, the jewelry attached to the ornamental clasp.

9. A brassiere with a brassiere cup adjustment device for applying rotational pressure to brassiere cups, comprising:

a brassiere having adjacent first and second brassiere cups; and cup rotation means for applying opposing rotational forces to adjacent brassiere cups in a brassiere, further comprising:

first attachment means attached to a first end of the cup rotation means for attachment of the first end of the cup rotation means to a first brassiere cup;

second attachment means attached to a second end of the cup rotation means for attachment of the second end of the cup rotation means to a second brassiere cup; and the cup rotation means further applying tension to the first and second brassiere cups where the cup rotation means are attached to the brassiere cups;

the tension generated by the cup rotation means, when the cup rotation means are attached to an upper portion of the brassiere cups, providing rotational pressure to rotate the upper portion of the brassiere cups toward one another, and when the cup rotation means are attached to a lower portion of the brassiere cups, providing rotational pressure to rotate the upper portion of the brassiere cups away from one another;

whereby the rotational pressure applied to the brassiere cups causes the brassiere cups to rotate and to alter the amount of perceived cleavage when the brassiere is worn.

10. A device, as in claim 9, wherein:

the cup rotation means further comprises a hook assembly, the hook assembly further comprising first and second hook attachments, the first hook attachment attachable at a first end to the first brassiere cup and having means at a second end to attach to the second hook attachment, and the second hook attachment attachable at a first end to the second brassiere cup and having means at a second end to attach to the first hook attachment.

11. The device, as in claim 9, wherein:

the cup rotation means further comprises a tie strap, the tie strap further comprising first and second straps, the first strap attachable at a first end to the first brassiere cup and having means at a second end to tie to a second tie strap, and the second tie strap attachable at a first end to the second brassiere cup and having means at a second end to tie to the first strap.

12. A device, as in claim 11, wherein the cup rotation means is an ornamental clasp.

13. A device, as in claim 12, further comprising:

jewelry, the jewelry attached to the ornamental clasp.

14. A device, as in claim 9, wherein:

the brassiere is an upper portion of a two-piece bathing suit.

15. A method of adjusting breast cleavage by applying rotational pressure to brassiere cups, including the steps of:

attaching cup rotation means to a brassiere having adjacent first and second brassiere cups such that tension from the cup rotation means creates rotational pressure on the first and second brassiere cups; and applying opposite rotational pressure applying to each of the brassiere cups such that when the rotational pressure is applied to an upper portion of the brassiere cups, the upper portion of the brassiere cups will rotate toward one another, and applying opposing rotational forces to each of the brassiere cups such that when attached to a lower portion of the brassiere cups, the upper portion of the brassiere cups rotate away from one another;

whereby the rotational pressure applied to the brassiere cups causes the brassiere cups to rotate and to alter the amount of perceived cleavage when the brassiere is worn.

16. A method, as in claim 15, including the additional step of:

attaching the cup rotation means to the brassiere such that it is removable.

17. A method, as in claim 16, including the additional steps of:

attaching a first end of a first hook attachment to a first brassiere cup and attaching a first end of a second hook attachment to a second brassiere cup; and attaching a second end of the first hook attachment to the second end of the second hook attachment.

18. A method, as in claim 16, including the additional step of:

using a connecting strap fabricated from hook and loop material as the cup rotation means by attaching a first end of the connecting strap to a first end of a first brassiere cup and attaching a second end of the connecting strap to a second brassiere cup.

19. A method, as in claim 16, including the additional step of:

using an ornamental clasp as the cup rotation means.

20. A method, as in claim 19, including the additional steps of:

attaching jewelry to the ornamental clasp.

21. A method, as in claim 15, including the additional step of:

permanently attaching the cup rotation means into the brassiere.

22. A method, as in claim 21, including the additional steps of:

attaching a first end of a first hook attachment to a first brassiere cup and attaching a first end of a second hook attachment to a second brassiere cup; and attaching a second end of the first hook attachment to the second end of the second hook attachment.

23. A method, as in claim 23, including the additional step of:

using a tie strap, having first and second straps, as the cup rotation means, and further attaching the first strap at a first end to the first brassiere cup and attaching the second end to a second tie strap, and attaching a first end of the second strap to the second brassiere cup.

24. A method, as in claim 21, including the additional step of:

using an ornamental clasp as the cup rotation means.

25. A method, as in claim 24, including the additional steps of:

attaching jewelry to the ornamental clasp.

26. A method, as in claim 15, including the additional step of:

attaching a connecting strap comprised of a tie string, the connecting strap attached at a first end to a button on a first brassiere cup and attached at a second end to a button on a second brassiere cup.

27. A method, as in claim 15, including the additional step of:

using the upper portion of a two-piece bathing suit as the brassiere.

* * * * *